US006139375A

United States Patent [19]

Konoya et al.

[11] Patent Number: 6,139,375

[45] Date of Patent: Oct. 31, 2000

[54] ELECTRICAL CONNECTOR HAVING A TERMINAL RETAINER AND METHOD OF OPERATION OF A TOOL THEREON

[75] Inventors: Hisashi Konoya; Hideto Nakamura, both of Yokkaichi, Japan

[73] Assignee: Sumitomo Wiring Systems, Ltd., Mie, Japan

[21] Appl. No.: 09/276,122

[22] Filed: Mar. 25, 1999

[30] Foreign Application Priority Data

Mar. 27, 1998 [JP] Japan ..... 10-081948

[51] Int. Cl.[7] ..... H01R 13/514

[52] U.S. Cl. ..... 439/752

[58] Field of Search ..... 439/752, 164, 439/15, 595, 469, 483

[56] References Cited

U.S. PATENT DOCUMENTS 5,562,500 10/1996 Tsukaoshi ..... 439/752

5,934,946 8/1999 Nakamura ..... 439/752

FOREIGN PATENT DOCUMENTS 4-322079 11/1992 Japan .

*Primary Examiner*—Paula Bradley
*Assistant Examiner*—Phuongchi Nguyen
*Attorney, Agent, or Firm*—Oliff & Berridge, PLC

[57] ABSTRACT

In an electrical connector having a removable terminal retainer to hold the electrical terminals in place in a housing, a side surface of the housing is provided with a recess, and the retainer has a nose projecting into the recess. When shifting the retainer from its locking position so that the terminals can be removed or inserted, a lever action is achieved by engaging the front end of a tool with the nose of the retainer, the tool contacting the housing at a fulcrum point. The fulcrum point of the lever action is changed during the retainer removal action.

9 Claims, 7 Drawing Sheets

ELECTRICAL CONNECTOR HAVING A TERMINAL RETAINER AND METHOD OF OPERATION OF A TOOL THEREON

BACKGROUND OF THE INVENTION

1. Field of Invention

The present invention relates to an electrical connector, which in use contains at least one electrical terminal and is provided with a terminal retainer. The electrical connector of the invention is particularly, but not exclusively, applicable in a vehicle such as an automobile. The invention also relates to a method of operation of a tool on the connector in order to shift the retainer.

2. Description of Related Art

FIG. 7 shows a known electrical connector provided with a terminal retainer, as disclosed in Laid-Open Japanese Patent Application No. 4-322079. The connector of FIG. 7 in use makes connection to a corresponding mating connector to establish electrical connections. The connector of FIG. 7 has a plurality of electrical terminals 4 (only one is shown in FIG. 7 for simplicity) and a housing 1. To assemble the connector each terminal 4 is inserted into its desired location in the housing 1, and then a terminal retainer 3 is pressed from a temporary position shown in FIG. 7 in a retainer aperture 2 into a locking position in the housing to hold the terminal 4 at its correct insertion position.

In order to remove the terminal 4 from the housing to the temporary position, the retainer 3 must be shifted from the locking position. No method of moving the retainer from the locking position is described in this prior art disclosure.

SUMMARY OF THE INVENTION

It is an object of the present invention to provide an arrangement to facilitate shifting of the terminal retainer from its locking position in such an electrical connector.

It is another object to provide a method of operation of a tool on the electrical connector to shift the retainer from its locking position.

According to this invention, there is provided an electrical connector comprising a housing having opposite ends, a side surface and a retainer aperture that opens at the side surfaces, and a terminal retainer received in the aperture and adapted in use of the connector to lock at least one electrical terminal in position in the housing. The terminal retainer is locatable in the retainer aperture at a locking position in which it locks the electrical terminal or terminals in position and movable in the retainer aperture from the locking position. The side surface of the housing has a recess adjoining the retainer aperture. The retainer has a nose projecting towards one end of the housing and cooperatively arranged relative to the recess so that, in order to move the retainer from the locking position, a tool can be inserted into the recess to engage the nose and shift the retainer by a lever action on the housing.

By this measure, the tool can be operated with high efficiency.

Preferably, the recess has a flat base wall and a side wall facing the retainer and at an angle of at least 90° to the base walls. More preferably, the recess is at an obtuse angle to the base wall, e.g., more than 120°.

Preferably, the nose of the retainer has an under surface that faces inwardly with respect to the connector housing and is either (a) perpendicular to the movement direction of the retainer when shifted from the locking position or (b) inclined to the movement direction of the retainer so as to slope outward with respect to the connector housing towards the extremity of the nose.

For control of the tool, the housing preferably has a pair of projections projecting from the side surface thereof so as to provide a gap between them located so that when the tool is employed to shift the terminal retainer from the locking position, the tool is locatable between the projections, providing lateral guidance of the tool.

The invention in another aspect provides a method of operation of a tool on the electrical connector of the invention in order to shift the terminal retainer from its locking position. The method includes the steps of providing a tool having an engagement end adapted to engage under the nose of the terminal retainer and an operating portion e.g., handle, remote therefrom, and applying the tool to the connector with the engagement end engaging under the nose so as to establish a lever action about a first lever fulcrum at which the tool contacts the housing. The first lever fulcrum is between the operating portion and the engagement end of the tool, and the distance between the first lever fulcrum and the engagement end of the tool is less than the distance between the first lever fulcrum and the operating portion.

To control the lever force applied to the container by the tool, and reduce risk that the retainer is uncontrollably expelled from the connector housing, the first lever fulcrum is preferably at the recess of the side surface of the housing and, after an initial movement of the retainer from the locking position, the first lever fulcrum is replaced by a second lever fulcrum at which the tool contacts the housing, the second lever fulcrum being more remote from the nose of the retainer than the first lever fulcrum. The second lever fulcrum may be at the end of the housing, adjacent the pair of guide projections mentioned above. The retainer can therefore be shifted reliably by use of a small force on the tool.

BRIEF DESCRIPTION OF THE DRAWINGS

An embodiment of the invention will now be described by way of non-limiting example, with reference to the accompanying drawings, in which.

DESCRIPTION OF THE PREFERRED EMBODIMENT

Figure 1:
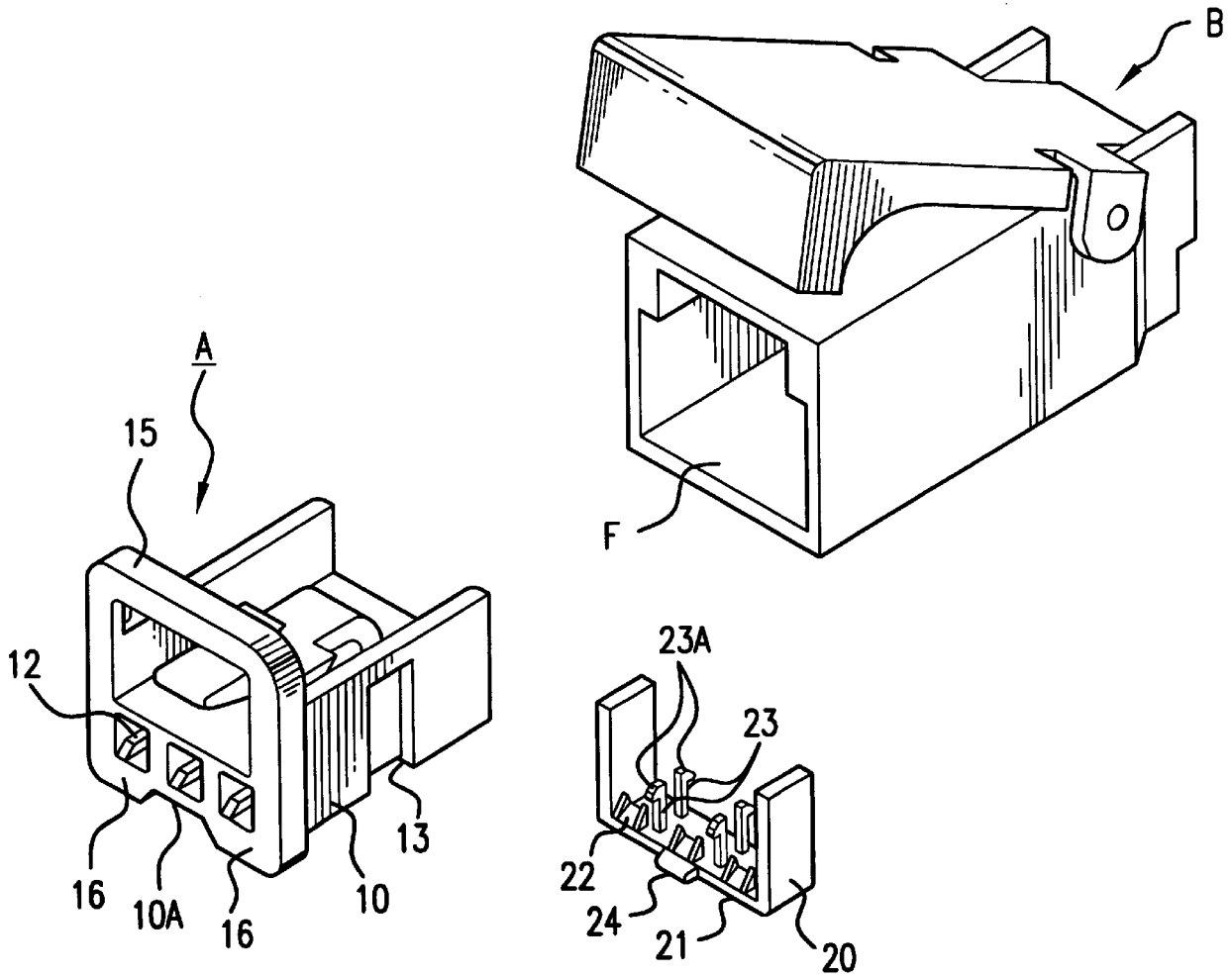
FIG. 1 is a perspective view showing a first connector as an embodiment of the present invention and a mating connector.
Figure 2:
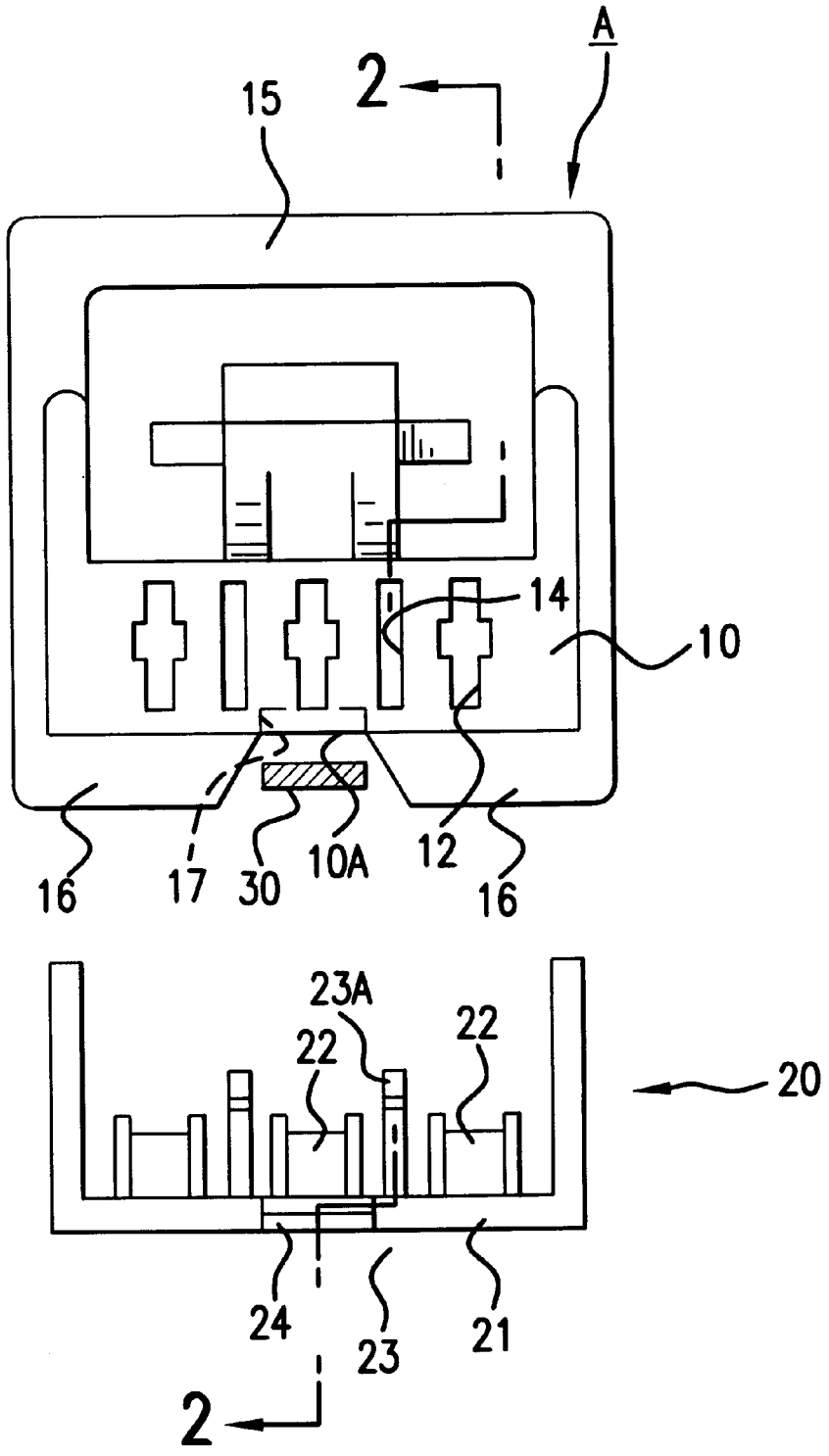
FIG. 2 is a front view of the first connector shown in FIG. 1, with a section line 2—2 of FIGS. 3 to 5.
Figure 3:
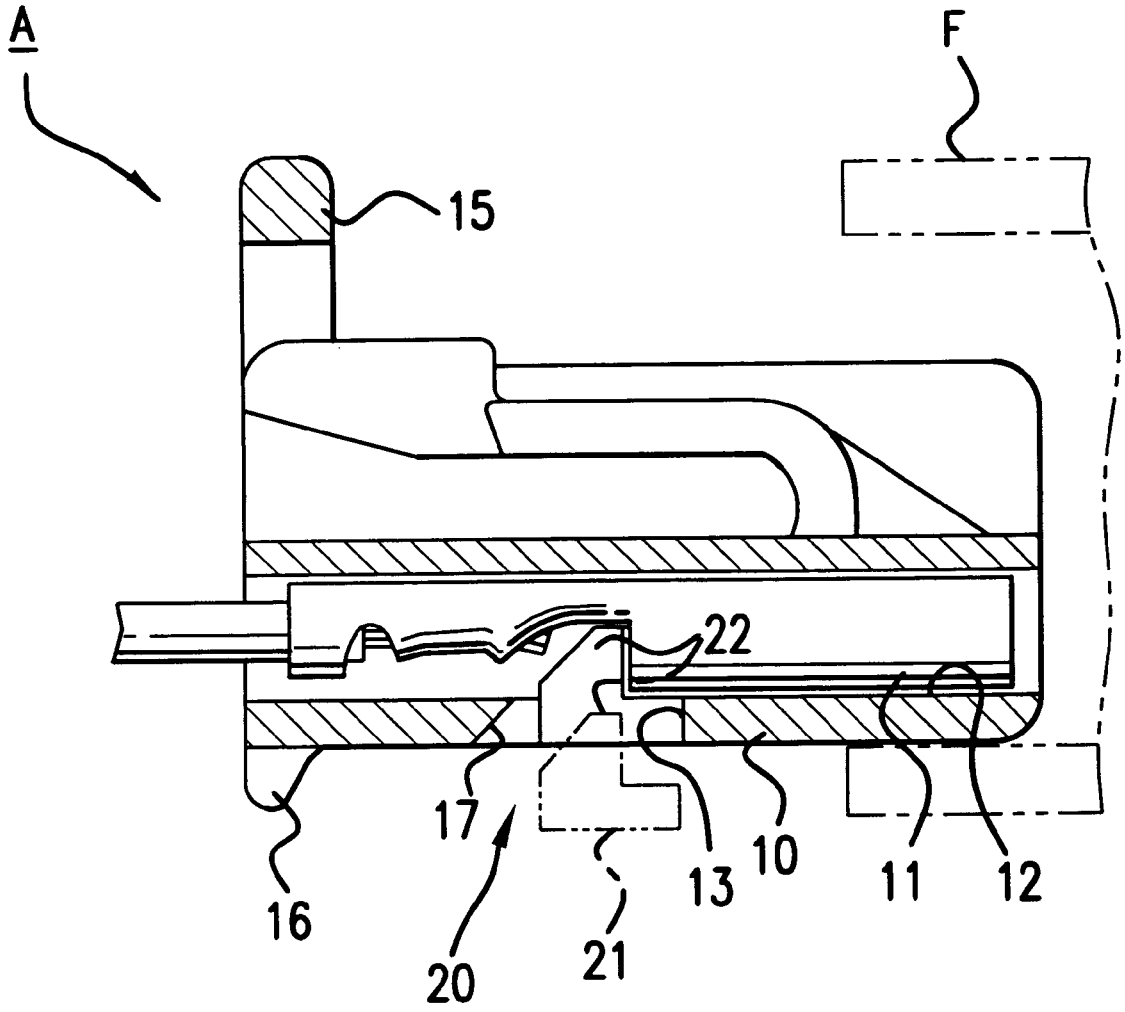
FIG. 3 is a sectional view showing a state in which a terminal is prevented from being removed from a housing of the first connector by means of a terminal retainer, in the embodiment of FIG. 1.

An embodiment of the present invention will be described with reference to FIGS. 1 to 6.

A connector A of the embodiment has a housing 10 and a terminal retainer 20. The housing 10 has three elongate chambers 12 into each of which an electrical terminal 11 is inserted (see FIG. 3) from the rear side (left side in FIGS. 1 and 3) of the housing 10. The housing 10 further has a retainer aperture 13 open on its lower side face. The retainer aperture 13 communicates with the chambers 12 and with two slit-shaped locking spaces 14 each formed between a pair of adjacent chambers 12. The housing 10 has at its rear end a gate-shaped frame 15 consisting of an upper bar and right and left side bars. A pair of transverse ribs 16 project above the lower side face at the rear edge of the lower side of the housing 10, and are spaced apart so as to leave a gap between them at the center part of the rear edge in the widthwise direction of the housing 10.

In use the housing 10 is fitted into a hood F of a mating connector B from the open rear end thereof. In the fully fitted position, the frame 15 and the ribs 16 being positioned along the rear edge of the hood F, with the frame 15 and the ribs 16 exposed to the outside. The mating connector B has electrical terminals (not shown) in a conventional manner to make contact with the terminals 11.

The retainer 20 has a base portion 21 elongate in the widthwise direction to close the retainer aperture 13 of the housing 10 when installed, three terminal removal-preventing elements 22 projecting upward from the upper surface of the base portion 21, and two locking elements 23 also projecting upward from the upper surface of the base portion 21. Each locking element 23 is U-shaped in side view. A pair of front and rear locking claws 23A are formed at the upper end of each locking element 23. They are of equal height. A locking projection 14A (see FIGS. 4 and 5) is formed on the rear end surface of each locking space 14 of the housing 10. The peripheral edge of the retainer aperture 13 in the locking space 14 serves as a locking receiving portion 14B.

Figure 6:
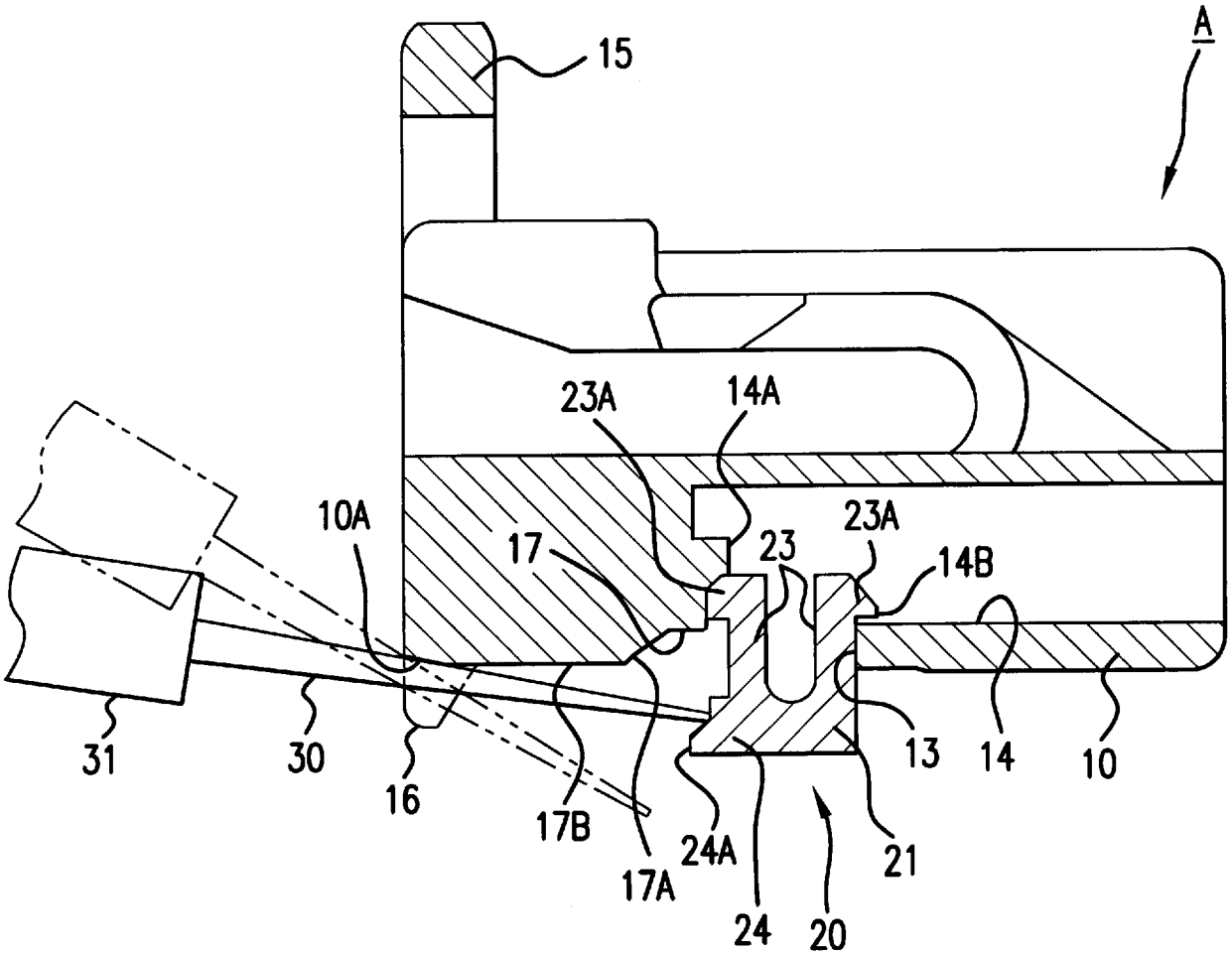
FIG. 6 is a sectional view showing a state in which the retainer has been shifted from the locking position to the temporary position, in the embodiment of FIG. 1.
Figure 7:
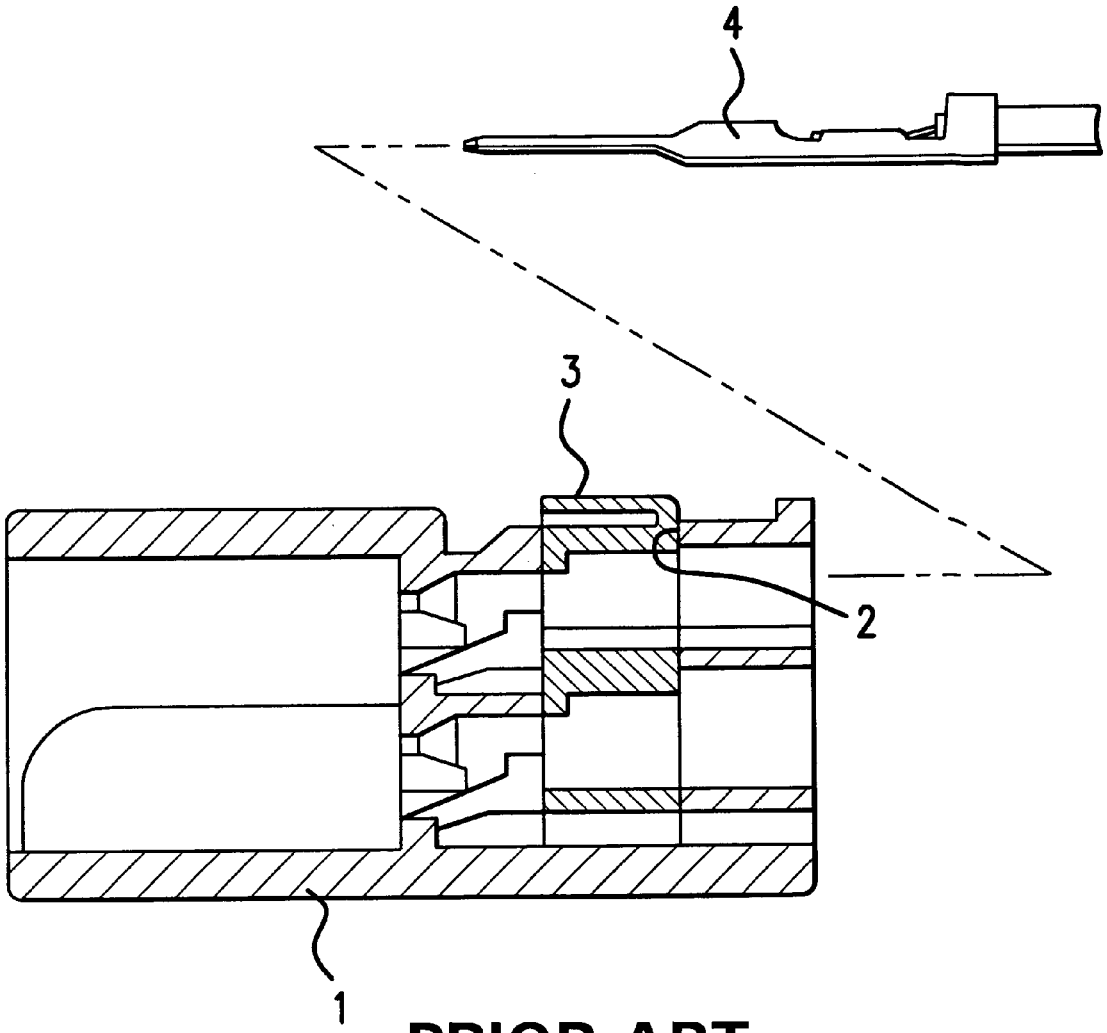
PRIOR ART FIG.7
FIG. 7 is a sectional view showing a known connector provided with a retainer, described above.

When the retainer 20 is pressed into the retainer aperture 13 to a small extent, the front locking claw 23A engages the locking receiving portion 14B, with the front locking claw 23A located over the locking receiving portion 14B. At this time, the rear locking claw 23A also engages the locking projection 14A, with the rear locking claw 23A located under the locking projection 14A. Consequently, the retainer 20 is held at a temporary position, as shown in FIG. 6. At the temporary position, each element 22 is positioned below the respective chamber 12 as shown by a two-dot chain line of FIG. 3. Thus, it is possible to insert the terminal 11 into the chamber 12 and remove it therefrom.

When the retainer 20 is pressed upward further into the retainer aperture 13, the rear locking claw 23A is sandwiched between the ceiling of the locking space 14 and the locking projection 14A. Thus, the retainer 20 is now held at a locking position. At the locking position, the elements 22 project into the chambers 12, thereby engaging the terminals 11 and preventing the terminals 11 from being removed from the chambers 12.

A shallow recess 17 is formed at the rear peripheral edge (edge at the left in FIGS. 4 to 6) of the retainer aperture 13. The ribs 16 are formed so that the space between the ribs 16 is widthwise coincident with the recess 17. The rear peripheral wall of the recess 17 is an inclined surface 17A continuous with the lower surface of the housing 10, with an obtuse angle of more than 120° formed between the inclined surface 17A and the lower surface of the housing 10. The base of the recess is parallel to the lower surface of the housing. As will be described later, a corner 17B forming the obtuse angle serves as a first lever fulcrum when shifting the retainer 20 from the locking position to the temporary position by means of a tool 30, using a lever action.

Figure 4:
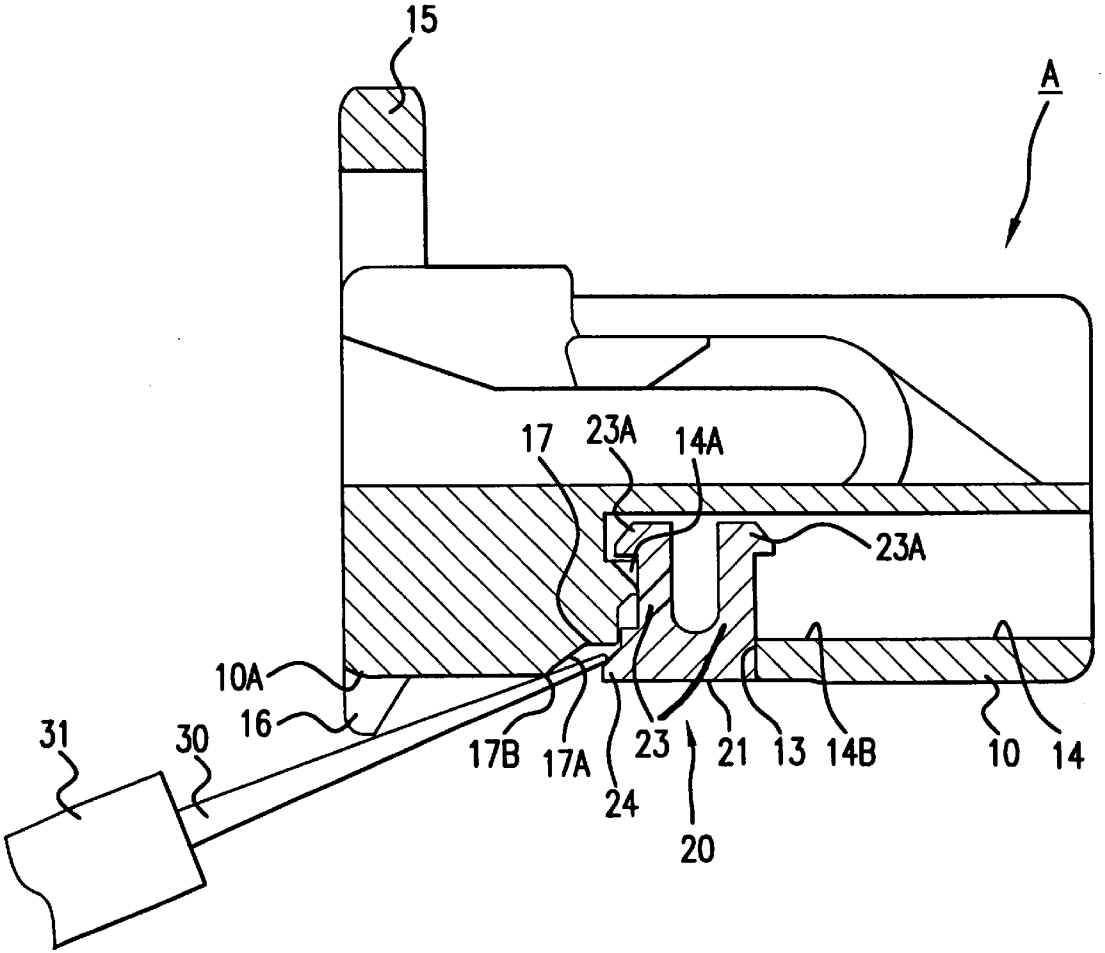
FIG. 4 is a sectional view showing a state in which a tool is engaged with the retainer, which is located at its locking position, in the embodiment of FIG. 1.

A projecting nose 24 is formed at the rear end of the retainer 20. The nose 24 faces the recess 17 and is partially within the recess 17, when the retainer 20 is at the locking position. A gap into which the front end of the tool 30 can be inserted exists between the upper surface (inward facing surface) of the nose 24 and the base wall of the recess 17 and between the rear end (distal end) of the nose 24 and the inclined surface 17A, as shown in FIG. 4. This gap allows the front end of the tool 30 to be inserted forward into the recess 17 to locate the front end of the tool 30 over the nose 24.

The tool 30 has a shape similar to that of a screw driver, thus being long and narrow lengthwise and slightly tapered such that it becomes gradually thinner toward the front end thereof. A large-diameter operation portion 31 is formed at the rear end of the tool 31 so that an operator can grip it easily. The operation portion 31 is positioned rearward from the ribs 16 when an operator has caught the tool 30 on the retainer 20. The operation portion 31 serves as the force-applying point in the lever action. The distance between the lever fulcrum point 17B and the nose 24 serving as the lever action point is about ⅕ of the distance between the operation portion 31 and the lever fulcrum point 17B.

Figure 5:
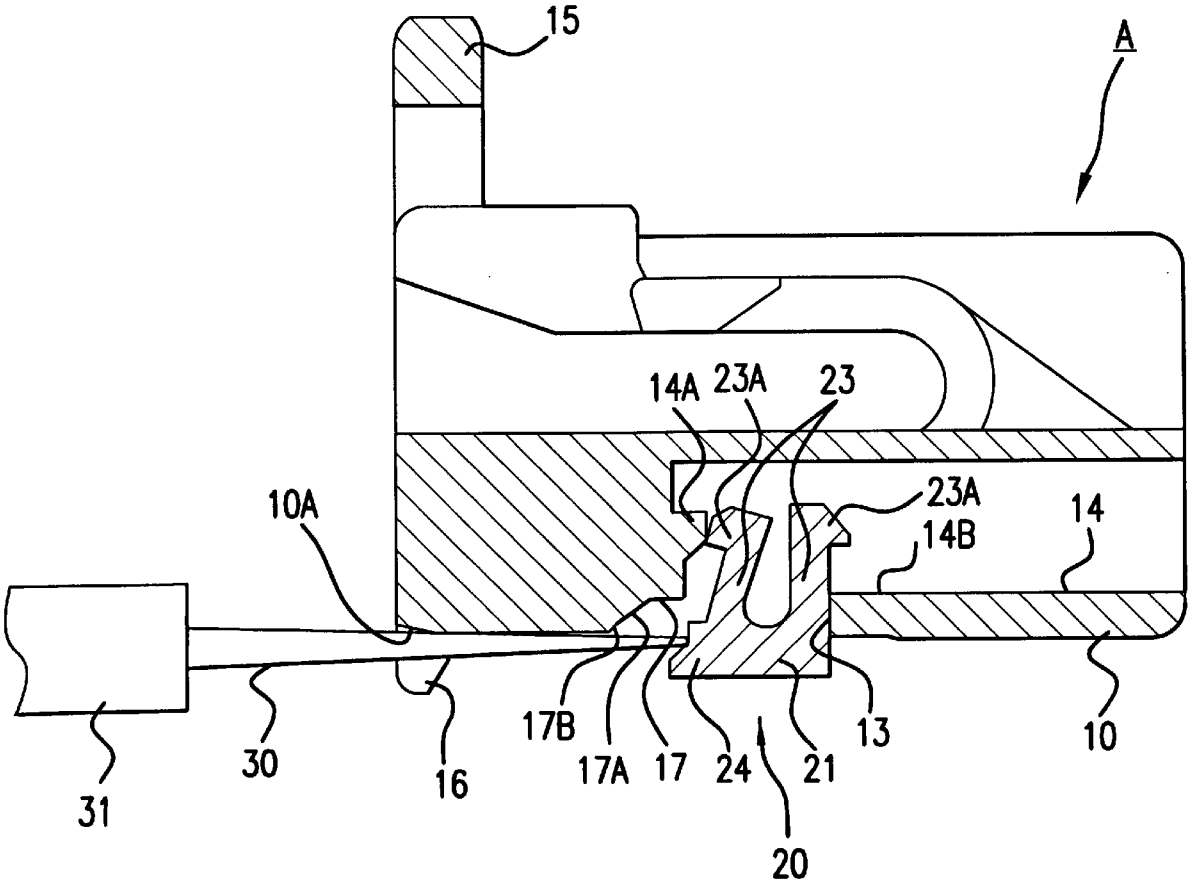
FIG. 5 is a sectional view showing a state in which the retainer is being shifted from its locking position to a temporary position, in the embodiment of FIG. 1.

Referring to FIGS. 4 to 6, the tool 30 overlaps the ribs 16 in side view when the front end of the tool 30 is in engagement with the nose 24 of the retainer 20 at the temporary position thereof, with the tool 30 in contact with the lever fulcrum 17B. The tool 30 also overlaps the ribs 16 in the process of approaching the tool 30 to the lower surface of the housing 10 in the state shown in FIG. 4.

The operation of the embodiment will now be described.

Referring to FIG. 4, in shifting the retainer 20 from its locking position to its temporary position, the front end of the tool 30 is inserted into the recessed portion 17 to engage it with the nose 24 of the retainer 20. Then, the angle of the tool 30 is changed to bring it to the lower surface of the housing 10. Thus, the tool 30 is brought into contact with the lever fulcrum 17B. At this time, the tool 30 is just positioned between the pair of ribs 16.

Then, the operation portion 31 is moved upward to rotate the tool 30 further towards the lower surface of the housing 10. As a result, the front end of the tool 30 presses the nose 24 downward by the lever action. Consequently, the rear locking claws 23A of the retainer 20 disengage from the locking projections 14A by flexing elastically, thus removing the retainer 20 from the locking position (see FIG. 5).

In removing the locking claws 23A from the locking projections 14A, it is necessary to apply a large downward force to the lever action point (nose 24) to elastically flex the rear locking claw 23A. Because the distance between the fulcrum 17B and the force-applying point (operation portion 31) is much longer than the distance between the fulcrum 17B and the action point (nose 24), a small applied force is sufficient for flexing the rear locking claw 23A.

Because the distance between the fulcrum 17B and the force-applying point and the distance between the fulcrum 17B and the action point are as described above, the shift of the nose 24 is small relative to the movement of the operation portion 31. Thus, when the tool 30 is operated rapidly with a large force, the retainer 20 moves slowly by a small amount. Accordingly, the retainer 20 is prevented from being thrown uncontrollably out from the housing 10 through the retainer aperture 13.

When the tool 30 is continued to be operated from the state shown in FIG. 5, the lever fulcrum is shifted to the rear end 10A of the housing 10. Thus, the distance between the fulcrum 10A and the action point (nose 24) becomes longer than the distance between the fulcrum 17B and the action point (nose 24). Further, the distance between the fulcrum 10A and the force-applying point (operation portion 31) becomes shorter than the distance between the fulcrum 17B and the force-applying point. Therefore, the operation force to be applied to the operation portion 31 when the rear end 10A of the housing 10 acts as the lever fulcrum is greater than that to be applied when the corner 17B acts as the lever fulcrum. But the downward operation force required to be applied to the action point (nose 24) after the rear locking claw 23A disengages from the locking projection 14A is resistant to only the sliding resistance acting between the locking claw 23A and the locking projection 14A. Thus, it is not necessary to apply a great force to the operation portion 31 at this time.

When the retainer 20 has reached the temporary position (FIG. 6), the rear locking claws 23A flex elastically. As a result, the rear locking claws 23A engage the lower surfaces of the locking projections 14A, and the front locking claws 23A engage the upper surfaces of the locking receiving portions 14B, thus allowing the retainer 20 to be held at the temporary position.

The front end of the tool 30 shifts rearward from the retainer 20 while it is drawing a circular arc on the rear end 10A of the housing 10. Thus, when the tool 30 becomes inclined downwardly in the state in which the retainer 20 is at the temporary position shown in FIG. 6, the tool 30 slides on the inclined upper surface 24A of the nose 24 and disengages therefrom, as shown by a two-dot chain line of FIG. 6. That is, the retainer 20 can be held at the temporary locking position reliably, and excess movement of the retainer 20 by the tool 30 is avoided.

As described above, the tool 30 remains sandwiched between the pair of the ribs 16 while the retainer 20 is being shifted from the locking position to the temporary position. Thus, the tool 30 is prevented from moving widthwise, i.e. it can be reliably operated.

Further, the gate-shaped frame 15 and the ribs 16 are exposed outside of the hood F when the connector A has been fitted in the mating connector B. Thus, in order to remove the connector A from the connector B, the housing 10 of the connector A can be easily removed from the hood F by pressing the gate-shaped frame 15 and the rib 16 with fingers.

It is necessary to apply the largest downward force to the lever action point to remove the retainer 20 from the locking position in an early stage of operating the tool 30. The distance between the fulcrum 17B and the lever action point of lever (nose 24) is shorter than that between the fulcrum 17B of lever and the force-applying point (operation portion 31). Thus, the retainer-shifting operation can be accomplished reliably by applying a small force to the tool 30.

The present invention is not limited to the embodiment described above with reference to the drawings, but variations described below are also included in the technical scope of the present invention and other modifications may also be made within the spirit and scope of the present invention.

For example, although the ribs 16 are formed on the rear end of the housing in the illustrated embodiment, three ribs may be formed at a position forward from the rear end.

Also, although the lever fulcrum in using the tool is positioned between the retainer aperture and the ribs 16, the ribs may be positioned forward from the rear end of the housing and the lever fulcrum may be positioned rearward from these ribs.

Further, a female-side connector has been described in the illustrated embodiment, the present invention may be applied to a male-side connector.

What is claimed is:

1. An electrical connector comprising:

a housing having opposite ends, a side surface and a retainer aperture that opens at said side surface;

a terminal retainer received in said retainer aperture and adapted to lock at least one electrical terminal in position in said housing; and a pair of projections projecting from said side surface, the pair of projections being spaced apart to form a zap and having a configuration that facilitates manual pulling of the housing in a longitudinal direction of the housing;

said terminal retainer being locatable in said retainer aperture at a locking position in which said terminal retainer locks said at least one electrical terminal in position and movable in said retainer aperture from said locking position, said side surface having a recess adjoining said retainer aperture and said terminal retainer having a nose projecting towards one of said opposite ends of said housing and cooperatively arranged relative to said recess so that, in order to move said terminal retainer from said locking position, a tool can be inserted into said recess to engage said nose and shift said terminal retainer by a lever action acting on said housing, said pair of projections laterally guiding the tool when the tool is inserted into said recess.

2. An electrical connector according to claim 1, wherein said nose of said terminal retainer has a surface that faces inwardly with respect to said housing and is one of (a) perpendicular to a movement direction of the retainer when shifted from said locking position and (b) inclined to said movement direction of the retainer so as to slope outwardly with respect to said housing towards an extremity of said nose.

3. An electrical connector according to claim 1, wherein said pair of projections is a pair of flanges extending outwardly from and substantially perpendicular to said side surface of said housing at said one end of said housing.

4. An electrical connector according to claim 1, wherein said recess has a flat base wall and a side wall facing said terminal retainer, said side wall being at an angle of at least 90° to said base wall.

5. An electrical connector according to claim 2, wherein said side wall of said recess is at an obtuse angle to said base wall.

6. A method for disengaging an electrical connector, the method comprising:

providing a connector comprising a housing having opposite ends, a side surface and a retainer aperture that opens at said side surface; a terminal retainer received in said retainer aperture and adapted in use of the connector to lock at least one electrical terminal in position in said housing; and a pair of projections projecting from said side surface, the pair of projections being spaced apart to form a gap and having a configuration that facilitates manual pulling of the housing in a longitudinal direction of the housing, said terminal retainer being locatable in said retainer aperture at a locking position in which said terminal retainer locks said at least one electrical terminal in position and movable in said retainer aperture from said locking position, said side surface having a recess adjoining said retainer aperture, said terminal retainer having a nose projecting towards one of said opposite ends of said housing and cooperatively arranged relative to said recess;

providing a tool having an engagement end adapted to engage under said nose of said terminal retainer and an operating portion remote therefrom;

inserting said tool into the passage until said engagement end engages under said nose, the tool being laterally guided by the pair of projections; and establishing a lever action of said tool about a first lever fulcrum at which said tool contacts said housing to shift said terminal retainer from said locking position, wherein said first lever fulcrum is between said operating portion and said engagement end of the tool, and a first distance between said first lever fulcrum and said engagement end of said tool is less than a second distance between said first lever fulcrum and said operating portion.

7. A method according to claim 6, wherein said first lever fulcrum is at said recess of said side surface of the housing, and wherein after initial movement of said retainer from said locking position said first lever fulcrum is replaced by a second lever fulcrum at which said tool contacts said housing, the second lever fulcrum being more remote from said nose of said retainer than said first lever fulcrum.

8. A method according to claim 7, wherein said first distance is about one-fifth of said second distance.

9. A method according to claim 7, further comprising the step of establishing a lever action about said second fulcrum.

* * * * *